US008469230B2

(12) United States Patent
Perkins et al.

(10) Patent No.: US 8,469,230 B2
(45) Date of Patent: Jun. 25, 2013

(54) PRODUCT DELIVERY AND DISCHARGE SYSTEM FOR A VENDING MACHINE

(75) Inventors: Jay F. Perkins, Pickerington, OH (US); Michael T. Kopczewski, Grove City, OH (US); Jeffrey T. DeBord, Worthington, OH (US); Douglas G. Schaefer, Columbus, OH (US); Rainer B. Teufel, Worthington, OH (US); Charles W. Percy, Aiken, SC (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 484 days.

(21) Appl. No.: 11/973,892

(22) Filed: Oct. 10, 2007

(65) Prior Publication Data

US 2008/0179343 A1 Jul. 31, 2008

Related U.S. Application Data

(60) Provisional application No. 60/850,273, filed on Oct. 10, 2006.

(51) Int. Cl.
*G07F 11/16* (2006.01)
*B65H 3/36* (2006.01)

(52) U.S. Cl.
USPC ..... 221/234; 221/233; 221/196; 221/195; 221/262; 221/236

(58) Field of Classification Search
USPC ..... 221/1–312 C
See application file for complete search history.

(56) References Cited

U.S. PATENT DOCUMENTS

| | | | | |
|---|---|---|---|---|
| 6,230,930 | B1 * | 5/2001 | Sorensen et al. | 221/131 |
| 6,247,610 | B1 * | 6/2001 | Ziesel et al. | 221/171 |
| 6,755,322 | B1 * | 6/2004 | Herzog et al. | 221/123 |
| 7,055,716 | B2 * | 6/2006 | Holdway et al. | 221/131 |
| 7,222,748 | B2 * | 5/2007 | Holdway et al. | 221/93 |
| 7,802,700 | B2 * | 9/2010 | Ardern et al. | 221/258 |
| 2005/0082309 | A1 * | 4/2005 | Holdway et al. | 221/131 |
| 2007/0084876 | A1 * | 4/2007 | Ardern et al. | 221/258 |

* cited by examiner

*Primary Examiner* — Michael K Collins

(57) ABSTRACT

A vending machine includes a cabinet having a product storage zone and a product delivery mechanism that transports a selected product to a consumer. The vending machine includes a door assembly pivotally mounted relative to the cabinet for selectively providing access to the product storage zone. The door assembly includes an outer, exposed surface and an inner surface that are spaced to define an inner door zone including a vertical drop zone that terminates in a delivery area. A portal is formed in the inner surface of the door assembly and leads from the product storage zone into the door zone. A discharge element is provided on the inner surface of the door assembly and cooperates with the product delivery mechanism to dispense the selected product through the portal as the product delivery mechanism moves past the portal.

21 Claims, 8 Drawing Sheets

PRODUCT DELIVERY AND DISCHARGE SYSTEM FOR A VENDING MACHINE

CROSS-REFERENCE TO RELATED APPLICATIONS

This application claims priority under 35 U.S.C. §119(e) to U.S. Provisional Patent Application No. 60/850,273 filed on Oct. 10, 2006, which is hereby incorporated by reference.

TECHNICAL FIELD

This disclosure pertains to the art of vending machines and, more particularly, to a product delivery and discharge system that releases a selected product through a portal provided in a door of the vending machine into a dispensing chamber for delivery to a consumer.

BACKGROUND

Vending machines for dispensing canned or bottled beverages or other products have long been known. Early model vending machines released similarly sized bottles, one at a time, following the deposit of a required purchase amount. In order to withdraw the selected bottle from the vending machine, a purchaser was required to, for example, slide the bottle along a track until reaching a release point, at which time the bottle could be removed from the machine. While effective, differences in bottle design, size, and shape made it necessary to develop product-specific vending machines. However, over time, the packaging of beverages in cans gained in popularity. The standardization of product containers brought on through the use of beverage cans made vending simpler. Many vending machine designs employed serpentine tracks that increase storage capacity and improve the overall efficiency of the vending operation.

Presently, product containers are once again available in various different sizes and shapes. Also, specialty beverages, such as sports and energy drinks, flavored teas, fruit juices, milk and the like, are growing in popularity. Typically, these beverages are packaged in glass or plastic bottles that have unique shapes, which are associated with the particular product. Given the wide variety of container sizes, mechanisms for delivering a selected product to a consumer must be readily adaptable or capable of accommodating a large number of different products. At present, transport mechanisms that transition in multiple planes to deliver a selected product to a consumer are growing in popularity. Typically, the selected product is either retrieved from a shelf or allowed to pass into a carrier portion of the transport mechanism, whereupon the carrier is shifted towards a dispensing area.

Once at the dispensing area, the product must be discharged from the transport carrier. Various mechanisms have been employed to discharge a selected product from a transport carrier into a dispensing area. In one example, the product is simply run along a conveyor belt into the dispensing area. In another example, the selected product is gently placed in the dispensing area. In still another arrangement, the product is simply ejected from the transport carrier and allowed to fall within the vending machine cabinet into the dispensing area.

In many vending machines, the dispensing area is laterally offset from the product storage area. For example, the product storage area may be defined between left and right upstanding inner walls, and products are discharged through one of the walls into a laterally spaced compartment located below a validator unit. With this arrangement, the product storage area is necessarily reduced in its lateral dimension. Other vending machines simply drop products to a lower retrieval chamber that is accessible through a frontal zone of the vending machine. Although these known arrangements enable the full width of the vending machine to be used for product storage, considerable measures must be taken to assure adequate protection from product theft through the frontal zone.

SUMMARY

This disclosure is directed to a product delivery and discharge system for a vending machine.

In a first embodiment, a vending machine includes a cabinet having a product storage zone and a product delivery mechanism configured to transport a selected product in the product storage zone. The vending machine also includes a door assembly configured to selectively provide access to the product storage zone. The door assembly includes an outer surface and an inner surface that are spaced to define an inner door zone. The vending machine further includes a portal formed in the inner surface of the door assembly. The portal leads from the product storage zone into the inner door zone. In addition, the vending machine includes a dispensing area having an opening formed in the outer surface of the door assembly that provides access to the selected product. The inner door zone includes a vertical drop zone that extends from the portal to the dispensing area.

In a second embodiment, a vending machine includes a cabinet having a product storage zone and a product delivery mechanism configured to transport a selected product in the product storage zone. The vending machine also includes a door assembly configured to selectively provide access to the product storage zone. The door assembly includes an outer surface and an inner surface that are spaced to define an inner door zone. The vending machine further includes a portal formed in the inner surface of the door assembly. The portal leads from the product storage zone into the inner door zone. In addition, the vending machine includes a discharge element on the inner surface of the door assembly. The discharge element is configured to cooperate with the product delivery mechanism to dispense the selected product through the portal.

In a third embodiment, a method includes transporting a selected product from a product storage zone in a vending machine towards a portal formed in a door assembly of the vending machine. The method also includes guiding the selected product through the portal into a door zone defined between an inner surface portion of the door assembly and an outer surface portion of the door assembly. In addition, the method includes dropping the selected product through a vertical drop zone defined within the door zone to a dispensing area.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 11, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
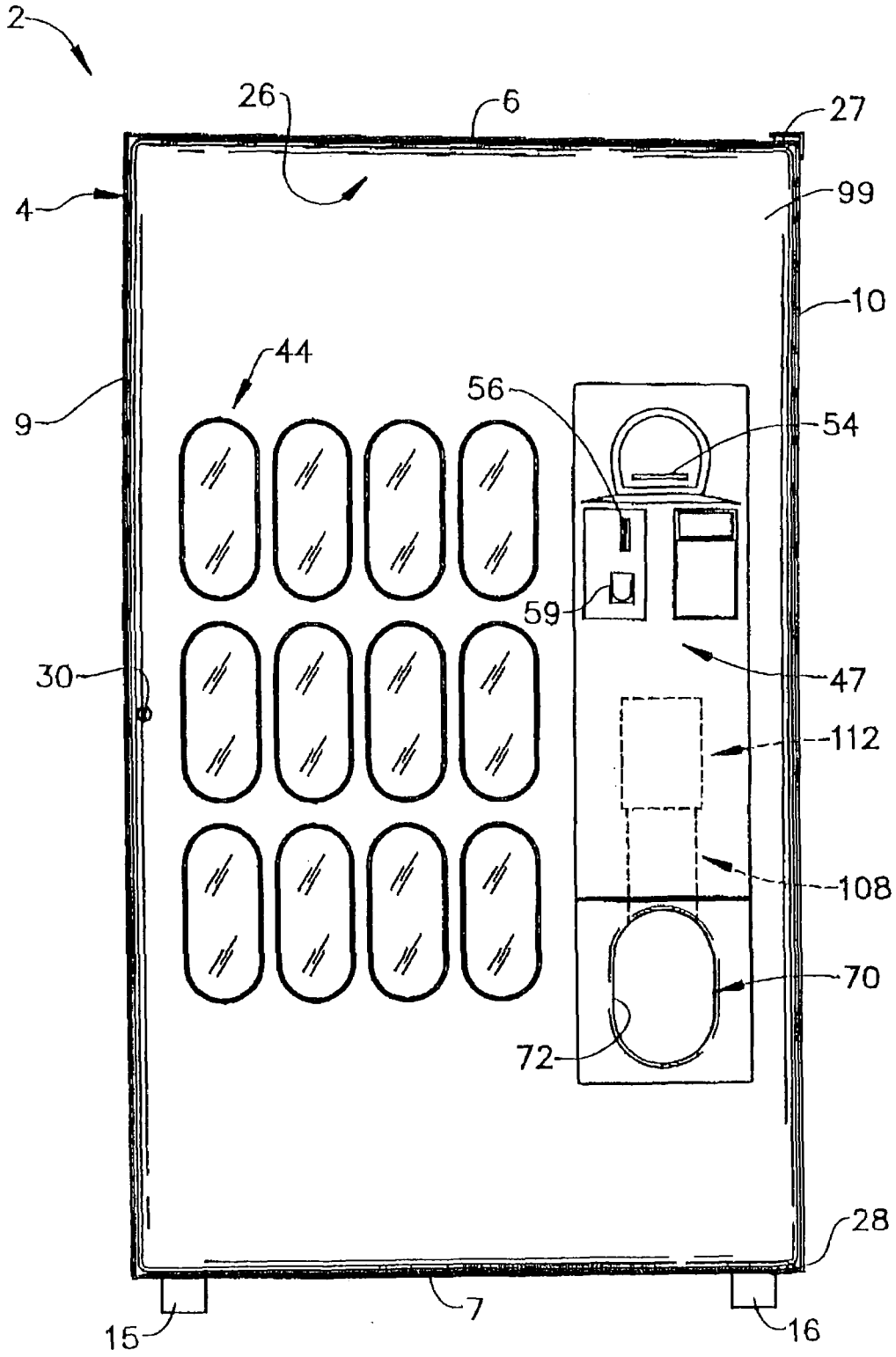
FIG. 1 is a front elevational view of a vending machine incorporating a product delivery and discharge system constructed in accordance with this disclosure.
Figure 2:
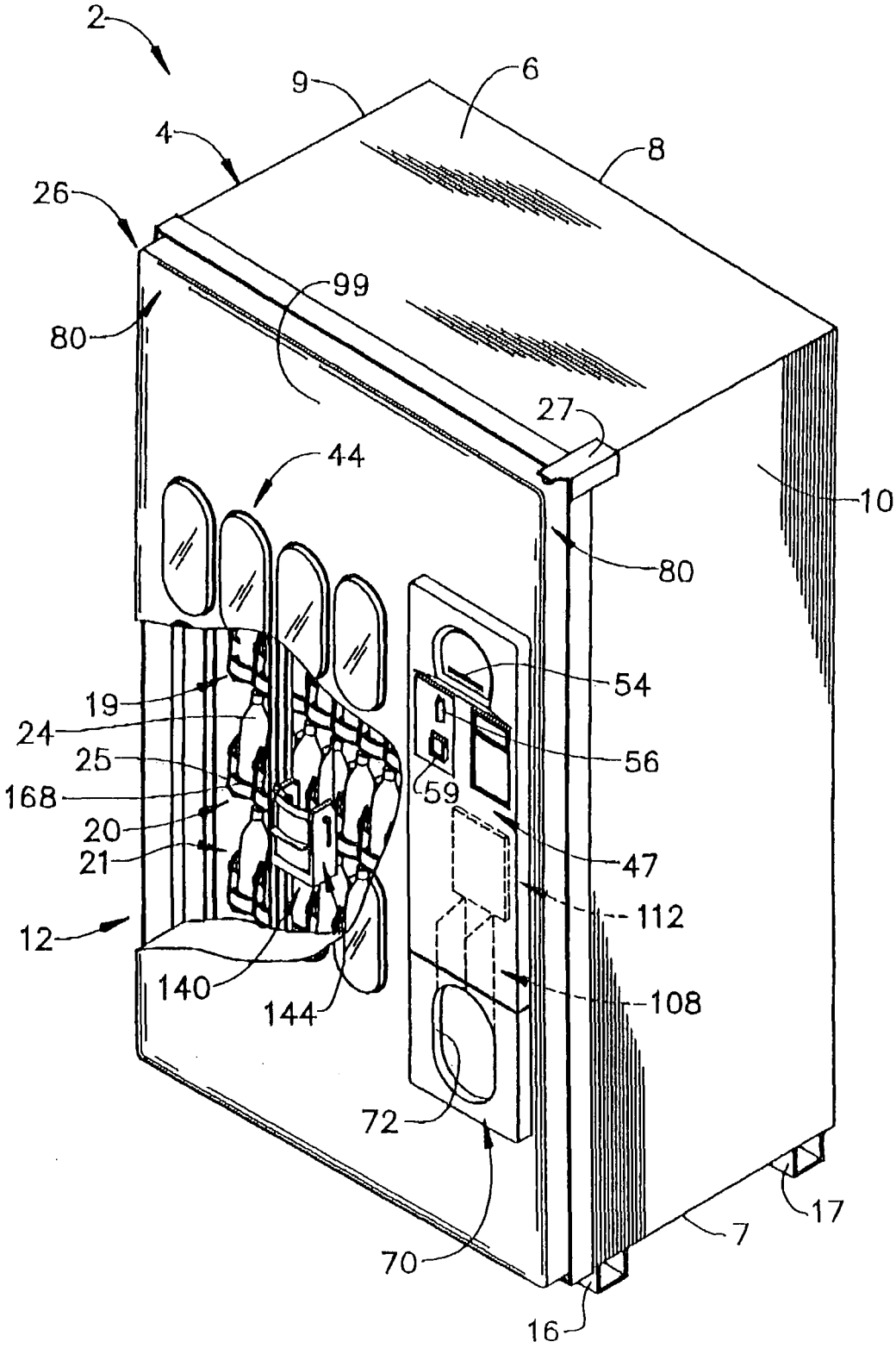
FIG. 2 is an upper right, partially cut-away perspective view of the vending machine of FIG. 1.

With initial reference to FIGS. 1 and 2, a vending machine 2 includes a cabinet 4 having a top portion 6, a bottom portion 7, a rear portion 8, and opposing side portions 9 and 10 that collectively define an internal product storage zone 12. Vending machine 2 also includes a plurality of leg members, three of which are indicated at 15-17, for supporting cabinet 4 on a floor surface. Vending machine 2 further includes a plurality of shelves, three of which are indicated at 19-21, that support various product containers, one of which is indicated at 24. Each product shelf 19-21 includes a plurality of laterally spaced product queues (not separately labeled), each having a respective release mechanism, one of which is indicated at 25, for releasing a selected product container 24 to a consumer. A door assembly 26 is pivotally mounted to cabinet 4, with at least a portion of door assembly 26 being connected through a pair of hinges 27 and 28 to selectively provide access to product storage zone 12. Door assembly 26 is also provided with a lock 30 that prevents unauthorized access to product storage zone 12.

As further shown in FIGS. 1 and 2, door assembly 26 is provided with a plurality of selection zones or windows, one of which is indicated at 44, that enables a consumer to see and choose between the various products offered by vending machine 2. In connection with making a selection, the consumer deposits a purchase price into a currency receiving zone 47. Currency receiving zone 47 includes a bill acceptor/validator 54, a coin slot 56, and a coin return area 59. In any case, following deposit of the purchase price and the selection of a desired product, vending machine 2 initiates a vending operation that, as will be discussed more fully below, results in delivery of the selected product container to a dispensing area 70. In order to retrieve the selected product, the consumer simply accesses dispensing area 70 through an opening 72 provided on door assembly 26.

Figure 3:
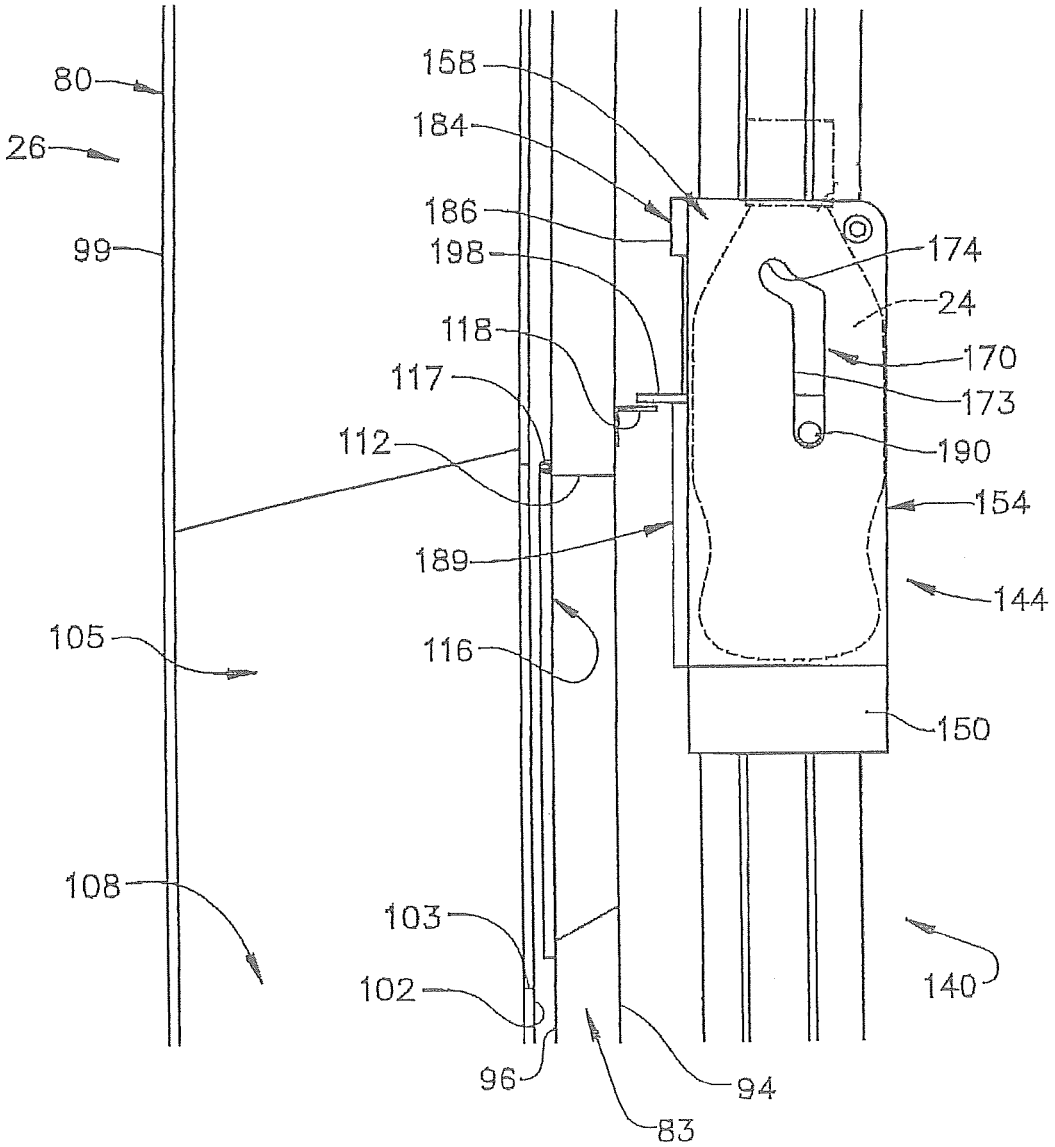
FIG. 3 is a side view of the vending machine of FIG. 1 illustrating a transport carrier prior to delivering a product constructed in accordance with a first embodiment of this disclosure.

As shown in FIG. 3, door assembly 26 includes a first or outer door member 80 and a second or inner door member 83. However, while door assembly 26 is described as having a dual door configuration, it should be readily apparent that door assembly 26 can take on a variety of forms, such as only having outer door member 80. Since vending machine 2 may be refrigerated, inner door member 83 may be provided to seal off product storage zone 12. In any event, inner door member 83 is shown to include an inner surface portion 94 and an outer surface portion 96. Conversely, outer door member 80 is shown to include an outer, exterior surface portion 99 and an inner surface portion 102. Inner surface portion 102 is provided with an opening or portal 103 that leads into a door zone 105 defined as the area between exterior surface portion 99 and inner surface portion 102. Portal 103 may be located at an intermediate portion (not separately labeled) of outer door member 80 between a top portion and a bottom portion thereof. Door zone 105 is provided with a vertical drop zone 108 that leads to dispensing area 70. In some embodiments, vertical drop zone 108 extends at least 8 inches (20.32 cm), such as approximately 12 inches (30.48 cm).

Inner door member 83 is provided with a portal 112 that registers with opening 103 and leads from product storage zone 12 into door zone 105. In the embodiment shown, portal 112 is provided with a door flap 116 hinged at an upper portion thereof by a hinge element 117. In some embodiments, hinge element 117 is a piano-type hinge that extends substantially a full width of door flap 116. In a manner that will be discussed more fully below, door assembly 26 is also provided with a discharge element 118 that, in the embodiment depicted, is mounted on inner surface portion 94 proximate portal 112. At this point, it should be realized that, if door assembly 26 only includes outer door member 80, discharge element 118 may be mounted to inner surface portion 102 proximate portal 103.

As discussed above, upon selecting a particular product, vending machine 2 initiates a vending operation to deliver selected product 24 to the consumer. Towards that end, vending machine 2 is provided with a product delivery mechanism 140 having a transport carrier 144. In some embodiments, product delivery mechanism 140 may shift transport carrier 144 in multiple planes, such as a vertical plane and a horizontal plane, to deliver selected product container 24 to the consumer. A more detailed description of product delivery mechanism 140 can be taken from U.S. patent application Ser. No. 11/249,526 filed Oct. 14, 2005 entitled "Product Transport System for a Vending Machine," which is hereby incorporated by reference.

Figure 4:
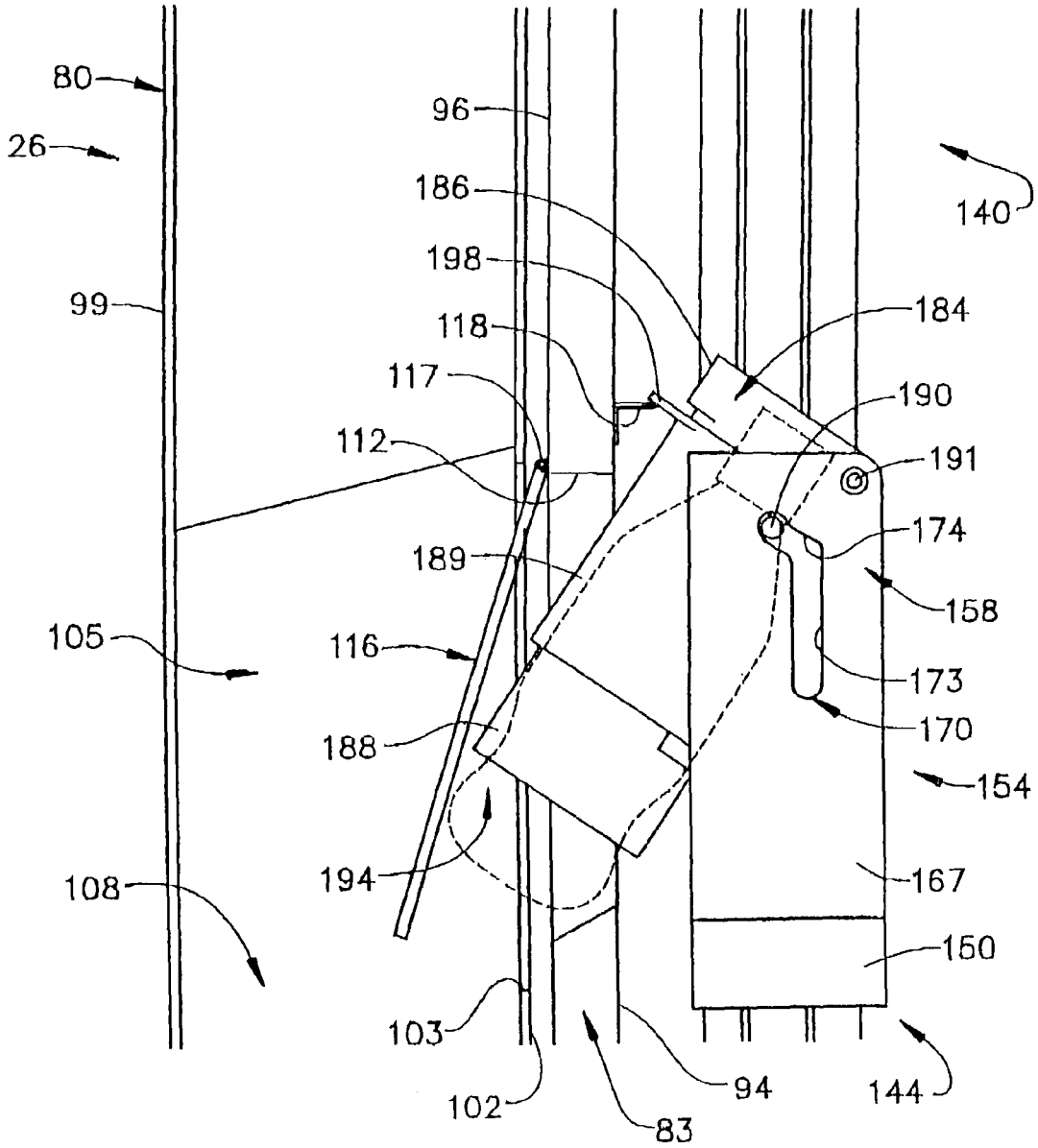
FIG. 4 is a side view of the transport carrier of FIG. 3 illustrating the product passing through a portal in a door assembly of the vending machine for delivery to a consumer.
Figure 5:
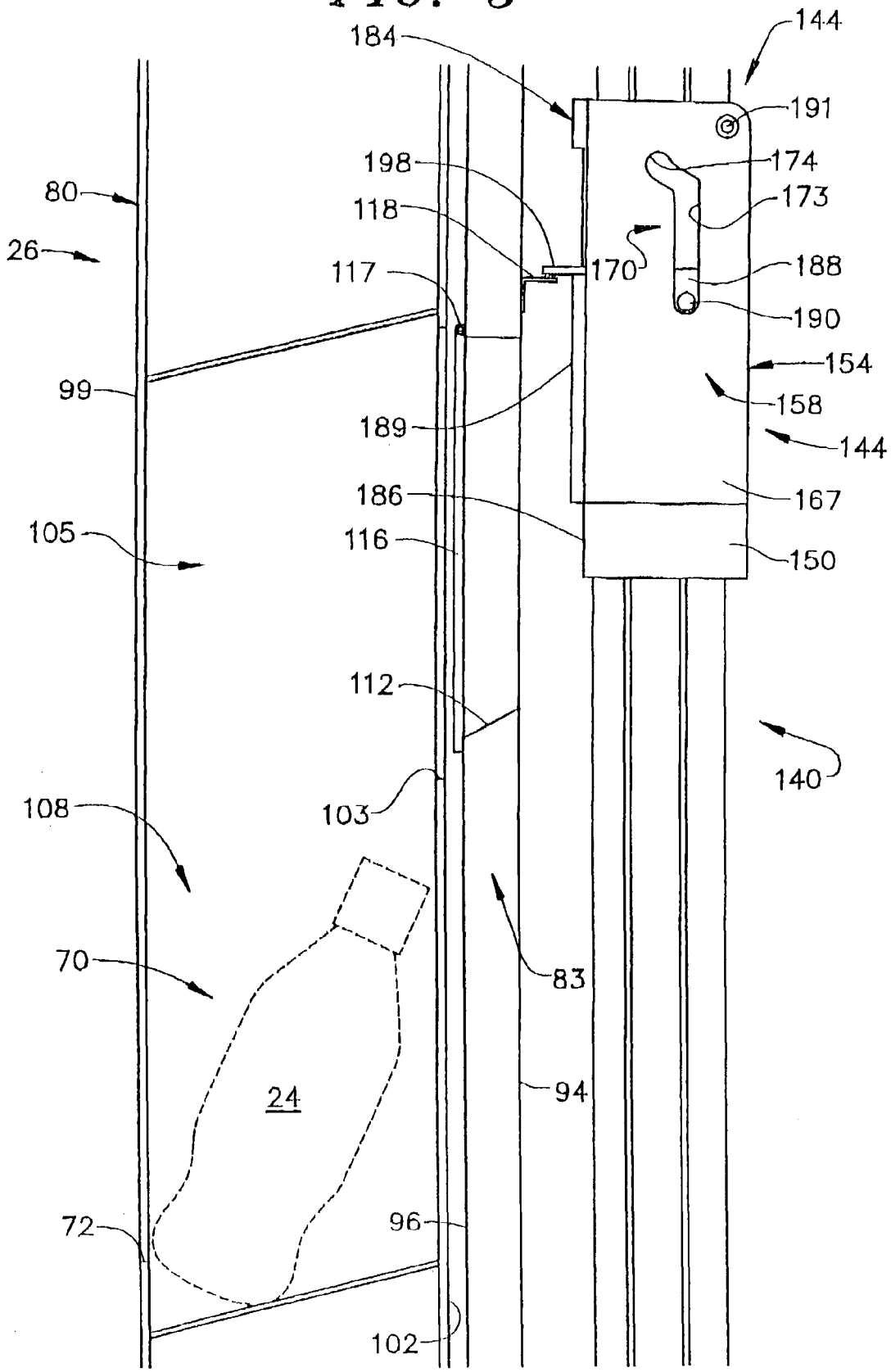
FIG. 5 is a side view of the transport carrier of FIG. 3 illustrating the product being ready for retrieval by a consumer after falling through a vertical drop zone provided in the door assembly.

In accordance with the embodiment shown in FIGS. 3-5, transport carrier 144 includes a base portion 150 and a shroud portion 154. Base portion 150 includes an outer base member 158 that is fixed to transport carrier 144 and has a pair of upstanding side walls 167 and 168 (FIG. 2), each provided with a respective guide track, one of which is indicated at 170. Guide track 170 includes a first or vertical portion 173 that extends to a second or angled portion 174.

Shroud portion 154 includes an inner shroud member 184 having a front wall 186 and a pair of side walls, one of which is indicated at 188, and an outer shroud member or sleeve 189 shiftably mount about inner shroud member 184. Outer shroud member 189 includes opposing guide pins, one of which is indicated at 190, that nest within guide track 170. Inner shroud member 184 carries a pivot pin 191 that pivotally or rotatably connects inner shroud member 184 to base portion 150. As shown in FIG. 4, inner shroud member 184 includes an open bottom portion 194 that enables selected product container 24 to release from transport carrier 144 through portal 112 into door zone 105 as will be discussed more fully below. Towards that end, outer shroud member 189 is also provided with an actuation element or tab member 198 that projects forward, substantially perpendicularly from a front wall (not labeled) of outer shroud member 189.

In accordance with the embodiment shown in FIGS. 3-5, inner shroud member 184 is selectively shifted between a first, product transport position as shown in FIG. 3 and a second, product discharge position as shown in FIG. 4. More specifically, upon receipt of a selected product container 24, transport carrier 144 is guided, in multiple planes, to a point just above portal 112, wherein tab member 198 is in alignment with discharge element 115. Once in position, product delivery mechanism 140 shifts transport carrier 144 downward, causing tab member 198 to contact discharge element 118 (FIG. 3). Transport carrier 144 continues moving downward, causing outer shroud member 189 to shift upward relative to inner shroud member 184. Correspondingly, each guide pin 190 is forced to move along first or vertical portion 173 of guide track 170. Upon reaching an end portion (not separately labeled) of first portion 173, guide pin 190 transitions into angled portion 174, causing both inner and outer shroud members 184 and 189 to pivot about pivot pin 191 (FIG. 4). The continued downward movement of transport carrier 144 forces shroud portion 154 against door flap 116 opening portal 112 as shown in FIG. 4. When portal 112 is open, the selected product container 24 releases through open bottom portion 194 into door zone 105. Product container 24 then passes through vertical drop zone 108 and settles in dispensing area 70 (FIG. 5). At this point, the consumer need simply access dispensing area 70 through opening 72 to retrieve the selected product container 24.

Figure 7:
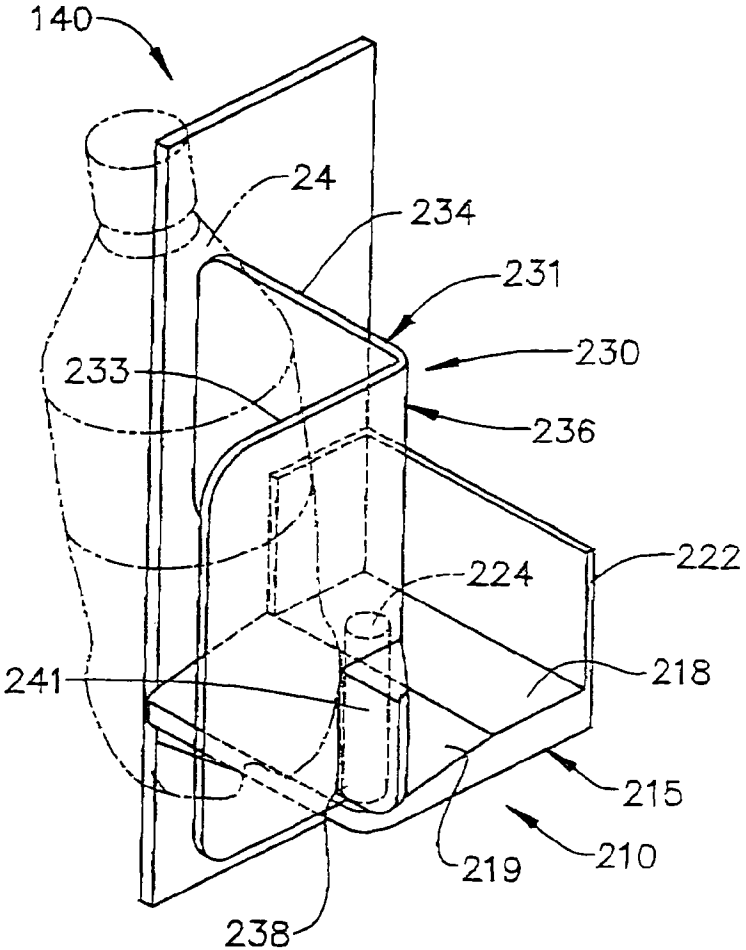
FIG. 7 is an upper left perspective view of the transport carrier of FIG. 6 illustrating the product being discharged.
Figure 6:
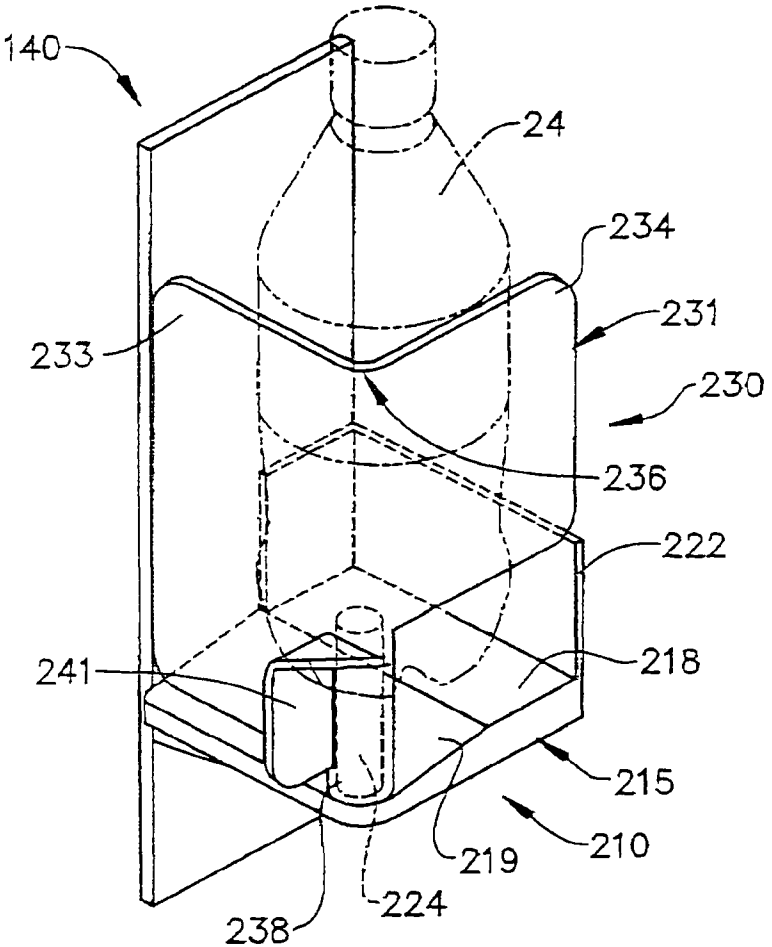
FIG. 6 is an upper right perspective view of a transport carrier prior to delivering a product through the portal constructed in accordance with a second embodiment of this disclosure.

Reference will now be made to FIGS. 6 and 7 in describing a transport carrier 210 constructed in accordance with a second embodiment of this disclosure. As shown in FIGS. 6 and 7, transport carrier 210 includes a base portion 215 operatively connected to product delivery mechanism 140. Base portion 215 includes a first, generally horizontal rear surface 218 that leads to a second, angled forward surface 219. Base portion 215 further includes a rear product support wall 222 and a pivot pin 224. Pivot pin 224 projects substantially perpendicularly upward from base portion 215 and is positioned at a front corner (not separately labeled) of angled surface 219. A shroud portion 230 is rotatably mounted to pivot pin 224. In a manner similar to that described above, shroud portion 230 transitions between a first, product retention position as shown in FIG. 6 and a second, product discharge position as shown in FIG. 7.

In accordance with the embodiment shown in FIGS. 6 and 7, shroud portion 230 is actually defined by a gate member 231 having first and second wing portions 233 and 234 that are joined at a corner region 236. Gate member 231 includes a sleeve 238 provided at corner region 236 that engages with pivot pin 224 to rotatably support gate member 231. Sleeve 238 includes an actuation element or tab member 241. Tab member 241 projects substantially perpendicularly outward from corner region 236 towards inner panel portion 94 when gate member 231 is in the product retention position of FIG. 6.

In a manner similar to that described above, after initiating a vending operation, product delivery mechanism 140 shifts transport carrier 210, possibly in multiple planes, towards a particular product queue to receive the selected product container 24. Upon receipt of product container 24, transport carrier 210 is shifted, again possibly in multiple planes, towards portal 112. Transport carrier 210 is positioned adjacent portal 112 with tab member 241 being aligned substantially coplanar with discharge element 118 that, in this embodiment, is mounted laterally offset from a vertical centerline of portal 112. At this point, it should be recognized that discharge element 118 can take various forms without departing from the scope of this disclosure. In general, discharge element 118 is constructed based on the structure in which it interacts or cams with.

In any case, transport carrier 210 is shifted horizontally, causing tab member 241 to engage with a side portion (not separately labeled) of discharge element 118. Continued horizontal shifting of transport carrier 210 causes gate member 231 to pivot about pivot pin 224, urging product container 24 through portal 112 into door zone 105. That is, as transport carrier 210 shifts horizontally, gate member 234 rotates. As gate member 234 turns, second wing member 234 urges product container 24 along base portion 215 and through portal 212. The movement of container 24 through portal 112 is facilitated by angled surface 219 of base portion 215. In any event, after passing through portal 112, container 24 transitions along vertical drop zone 108 prior to coming to rest in dispensing area 70.

Figure 9:
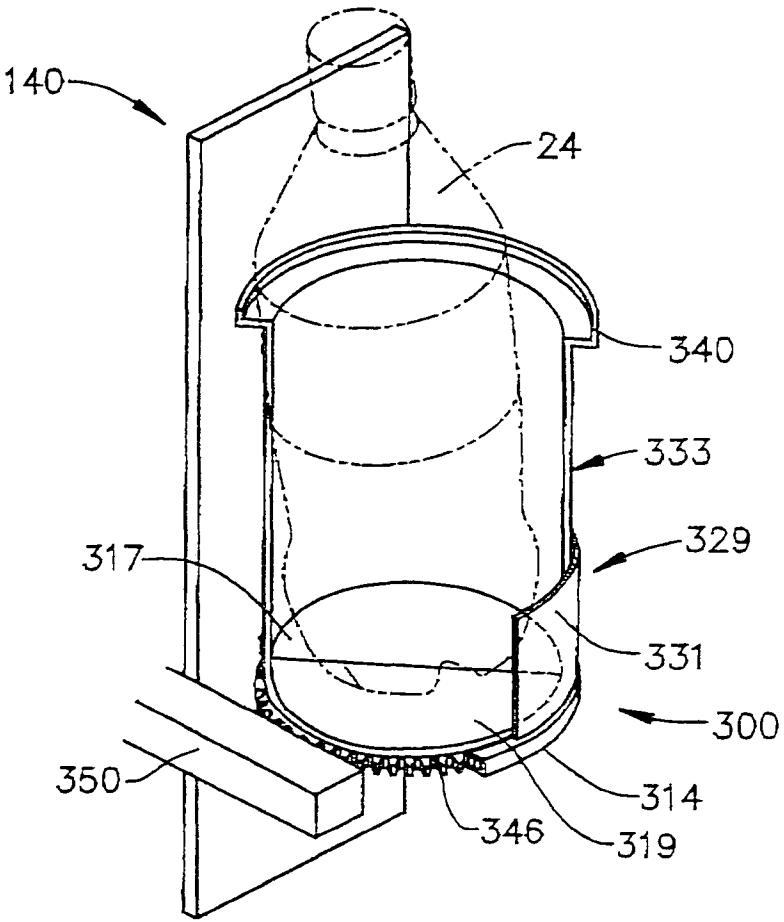
FIG. 9 is an upper right perspective view of the transport carrier of FIG. 8 illustrating the product being discharged.
Figure 8:
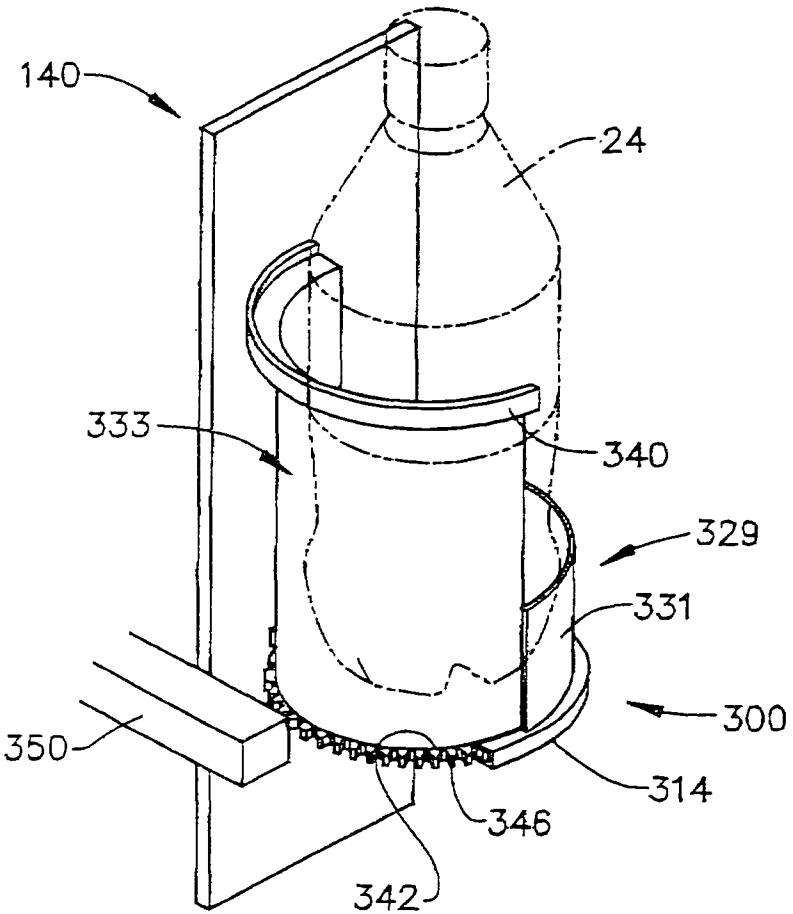
FIG. 8 is an upper right partially perspective view of a transport carrier prior to discharging a product constructed in accordance with a third embodiment of this disclosure.

Reference will now be made to FIGS. 8 and 9 in describing a product transport carrier 300 constructed in accordance with a third embodiment of this disclosure. As shown in FIGS. 8 and 9, transport carrier 300 includes a base portion 314 including a substantially flat portion 317 that leads to a generally angled portion 319. As will be discussed more fully below, base portion 314 includes a generally hollow interior portion (not separately labeled). Transport carrier 300 further includes a shroud 329 including a first or stationary portion 331 and a second or rotary portion 333. Rotary portion 333 is selectively shiftable between a first or product receiving position as shown in FIG. 8, wherein product container 24 is transitioned from a product queue into transport carrier 300, and a second or product release position as shown in FIG. 9, wherein product container 24 is released from transport carrier 300 into door zone 105. In any event, rotary portion 333 is shown to include an upper edge portion 340 that extends to a lower edge portion 342 defining a height substantially greater than stationary portion 331.

With this arrangement in FIGS. 8 and 9, when in the product transport position, stationary portion 331 and rotary portion 333 cooperate to retain product container 24. In any case, lower edge portion 342 is operatively connected to an actuator element that, in the embodiment shown, is constituted by a gear 346 that is positioned within the hollow interior portion of base portion 314. Gear 346 is configured to engage with a discharge element 350 mounted on interior surface portion 94 of inner door member 83. In some embodiments, discharge element 350 may be formed from an elastomeric or other pliable material. With this arrangement, the teeth of gear 346 will become embedded in fixed discharge element 250 and forced to rotate as product transport carrier 300 is continually shifted.

In accordance with the embodiment shown in FIGS. 8 and 9, upon receiving a product container 24, transport carrier 300 is shifted to a position adjacent portal 112 with gear 346 being aligned substantially coplanar with discharge element 350. At this point, transport carrier 300 is shifted horizontally, causing gear 346 to engage discharge element 350. As gear 346 travels along discharge element 350, rotary portion 333 begins to shift from the product retaining position (FIG. 8) to the product release position (FIG. 9). Once in the product release position, product container 24 slides along angled portion 319 through portal 112 into door zone 105, passes through vertical drop zone 108 and into dispensing area 70.

Figure 11:
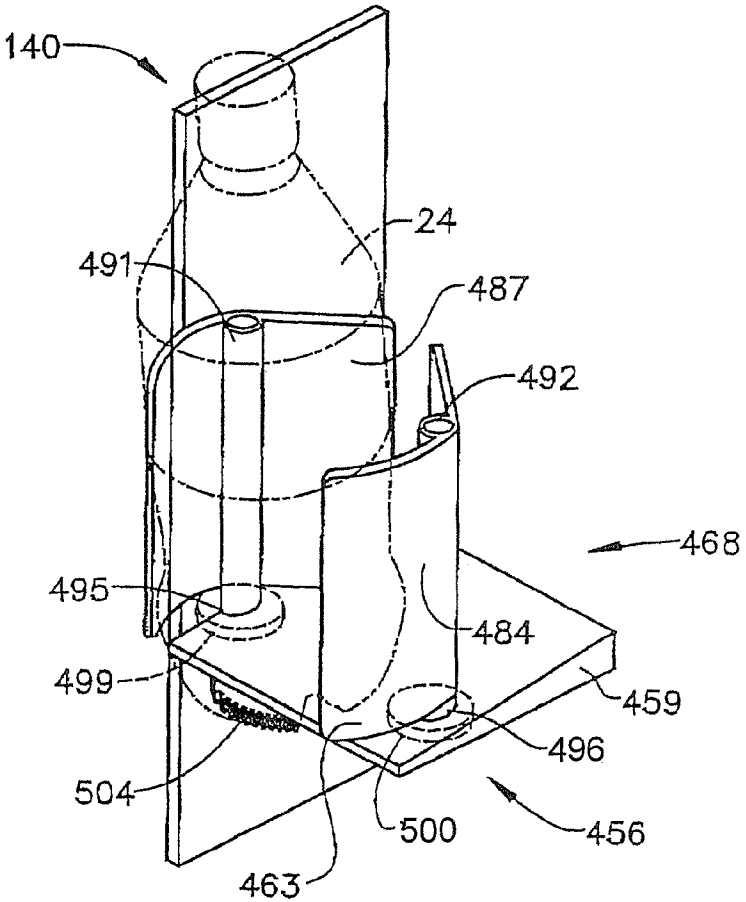
FIG. 11 is an upper right perspective view of the transport carrier of FIG. 10 illustrating the product being discharged.
Figure 10:
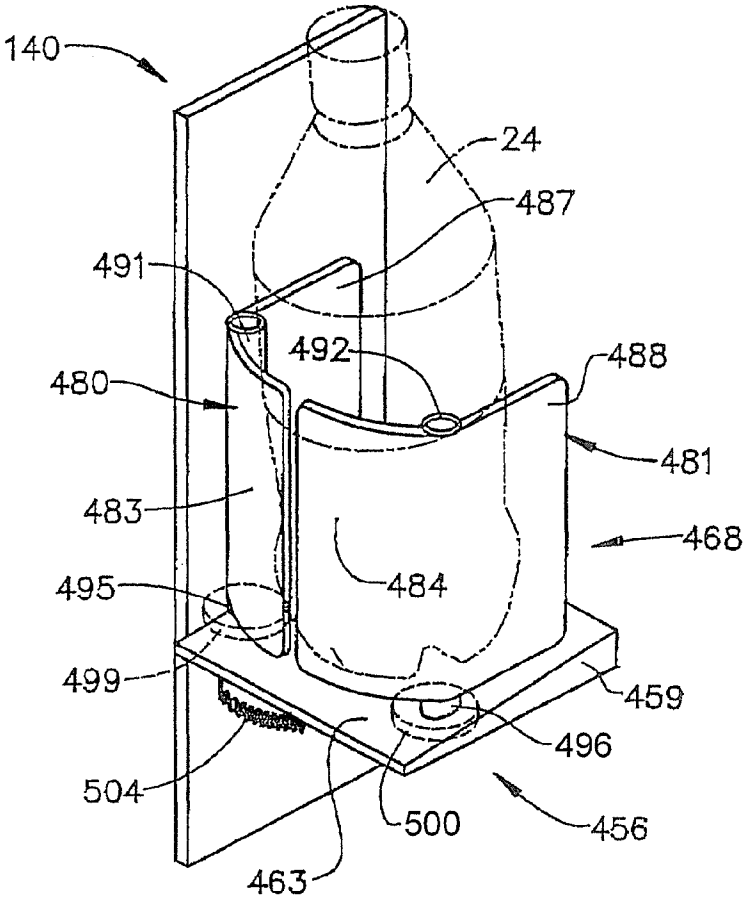
FIG. 10 is an upper right perspective view of a transport carrier prior to discharging a product constructed in accordance with a fourth embodiment of this disclosure.

Reference will now be made to FIGS. 10 and 11 in describing a transport carrier 456 constructed in accordance with a fourth embodiment of this disclosure. As shown in FIGS. 10 and 11, transport carrier 456 includes a base portion 459 having an upper, angled surface 463 and a shroud portion 468. Shroud portion 468 includes first and second gate members 480 and 481 each having corresponding first and second wing portions 483, 484 and 487, 488 respectively. As will be discussed more fully below, first and second gate members 480 and 481 transition between a first, product retaining position as shown in FIG. 10 and a second, product release position as shown in FIG. 11 to discharge a selected product container 24 towards dispensing area 70.

Each gate member 480, 481 includes a hinge portion 491, 492 positioned upon a corresponding pivot shaft 495, 496, which projects through base portion 459. Hinge portions 491 and 492 actually define an interface between corresponding ones of first wing portions 483 and 484 and second wing portions 487 and 488. In any event, pivot shafts 495 and 496 are connected to corresponding driven members 499 and 500 arranged on a bottom surface (not separately labeled) of base portion 459. Driven members 499 and 500 are operatively connected to an actuation element, shown as gear 504, that is configured to cooperate with a discharge element, such as discharge element 350 shown in FIGS. 8 and 9, to release the selected product container 24 as will be discussed more fully below.

In a manner similar to that described above, upon receipt of a product container 24, transport carrier 456 is guided in multiple planes to a position adjacent portal 112 with gear 504 being aligned substantially coplanar with discharge element 350. At this point, transport carrier 456 is shifted horizontally, causing gear 504 to engage with discharge element 350, thereby shifting first and second gate members 480 and 481 from the product transport position to the product release position. As first and second gate members 480 and 481 pivot about hinge portions 491 and 492 respectively, second wing portions 487 and 488 engage and urge product container 24 through portal 112 along angled upper surface 463 of base portion 459. That is, second wing portions 487 and 488 push the selected product container through portal 112. In a manner similar to that described above, product container 24 passes into door zone 105, falls through vertical drop zone 108 and is presented to a consumer in delivery area 70 for retrieval through opening 72.

It may be advantageous to set forth definitions of certain words and phrases that have been used within this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

At this point, it should be understood that the present invention provides various embodiments for reliably delivering and discharging a product container through a portal provided on a door of a vending machine. In particular, providing the retrieval port in the front of the door assembly enables substantially the full width of the vending machine cabinet to be used for product storage. In addition, the interaction between the product transport carrier and the discharge element provided on the door assembly establishes a reliable and effective overall dispensing system that can take a wide variety of configurations. Furthermore, the establishing of a vertical product drop zone in the door assembly not only represents an efficient use of space, but can also provide enhanced overall product security arrangement by providing an elongate, meandering path from the product dispensing area to the product storage zone.

Although described with reference to particular embodiments, it should be readily understood that various changes and/or modifications can be made to the invention without departing from the spirit thereof. For instance, the particular mechanism for releasing a product into the transport carrier can vary. Finally, while shown and described with vending machine 2 having a substantially solid door, glass front vending machines can also be readily employed. In general, the invention is only intended to be limited by the scope of the following claims.

What is claimed is:

1. A vending machine, comprising:

a cabinet having a product storage zone;

a product delivery mechanism configured to transport a selected product in the product storage zone, the product delivery mechanism including a transport carrier having a base portion, an outer shroud member, and an inner shroud member;

a door assembly configured to selectively provide access to the product storage zone, the door assembly including an outer surface and an inner surface that are spaced to define an inner door zone;

a portal formed in the inner surface of the door assembly, the portal leading from the product storage zone into the inner door zone;

a dispensing area having an opening formed in the outer surface of the door assembly that provides access to the selected product, wherein the inner door zone includes a vertical drop zone that extends from the portal to the dispensing area; and a discharge element on the inner surface of the door assembly, the discharge element configured to cooperate with the product delivery mechanism to dispense the selected product through the portal, wherein the outer shroud member is adapted to vertically shift relative to the inner shroud member then pivot at an angle relative to the base portion upon engagement of the transport carrier with the discharge element, the vertical shift and pivot of the outer shroud member facilitated by a guide track in the base portion that is adapted to engage a guide pin attached to the outer shroud member, the guide track comprising two straight track portions connected at an angle.

2. The vending machine according to claim 1, wherein the discharge element engages a tab member on the transport carrier in the product delivery mechanism as the transport carrier travels vertically.

3. The vending machine according to claim 1, further comprising:

a door flap pivotally mounted to the door assembly at the portal, the door flap configured to selectively move from a first position that substantially closes the portal to a second position that opens the portal and exposes the product storage zone to the door zone.

4. The vending machine according to claim 3, wherein the door assembly includes a top portion, a bottom portion, and an intermediate portion, the portal located at the intermediate portion, the dispensing area located proximate the bottom portion.

5. The vending machine according to claim 1, wherein the vertical drop zone extends at least 8 inches.

6. The vending machine according to claim 5, wherein the vertical drop zone extends approximately 12 inches.

7. The vending machine according to claim 1, wherein the door assembly includes an inner door member and an outer door member, the portal provided in the inner door member and leading to the vertical drop zone.

8. The vending machine according to claim 1, wherein the outer shroud member is adapted to shift between a product transport position and a product release position based upon contact with the discharge element.

9. The vending machine according to claim 1, wherein the outer shroud member pivots when the guide pin moves from a first straight track portion of the guide track to a second straight track portion.

10. A vending machine, comprising:

a cabinet having a product storage zone;

a product delivery mechanism configured to transport a selected product in the product storage zone, the product delivery mechanism including a transport member having at least one gate member rotatably mounted to a horizontal base portion of the transport member and rotating about a vertical axis;

a door assembly configured to selectively provide access to the product storage zone, the door assembly including an outer surface and an inner surface that are spaced to define an inner door zone;

a portal formed in the inner surface of the door assembly, the portal leading from the product storage zone into the inner door zone; and a discharge element on the inner surface of the door assembly, the discharge element configured to cooperate with the product delivery mechanism to dispense the selected product through the portal.

11. The vending machine according to claim 10, further comprising:

a dispensing area leading from the inner door zone, the dispensing area including an opening formed in the outer surface of the door assembly that provides access to the selected product following a vending operation, wherein the inner door zone includes a vertical drop zone that extends from the portal to the dispensing area.

12. The vending machine according to claim 10, further comprising a pivot pin projecting substantially upward from the base portion of the transport member, the gate member engaged with the pivot pin.

13. The vending machine according to claim 12, further comprising:

an actuator element operatively connected to the at least one gate member, the actuator element adapted to shift the at least one gate member about a substantially vertical axis when the transport carrier moves horizontally past the discharge element.

14. The vending machine according to claim 13, wherein the actuator element includes a gear operatively connected to the at least one gate member.

15. The vending machine according to claim 12, wherein the at least one gate member includes first and second wing portions, the first wing portion adapted to restrain the selected product, the second wing portion adapted to urge the selected product from the transport carrier when the at least one gate member shifts between the product transport position and the product release position.

16. The vending machine according to claim 12, wherein the at least one gate member includes first and second gate members rotatably mounted to the base section.

17. A method, comprising:

transporting a selected product from a product storage zone in a vending machine towards a portal formed in a door assembly of the vending machine;

engaging a discharge element on an inner surface portion of the door assembly;

upon engagement of the discharge element on the inner surface of the door assembly, vertically shifting an outer shroud member of a transport carrier relative to an inner shroud member of the transport carrier and pivoting the outer shroud member relative to a base portion of the transport carrier, wherein the vertical shifting and pivoting of the outer shroud member is facilitated by a guide track in the base portion that is adapted to engage a guide pin attached to the outer shroud member, the guide track comprising two straight track portions connected at an angle;

guiding the selected product through the portal into a door zone defined between the inner surface portion of the door assembly and an outer surface portion of the door assembly; and dropping the selected product through a vertical drop zone defined within the door zone to a dispensing area.

18. The method of claim 17, wherein the selected product is dropped at least 8 inches in the vertical drop zone.

19. The method of claim 17, further comprising:

transporting the selected product with a product delivery mechanism that shifts within the product storage zone in each of a vertical plane and a horizontal plane to transport the selected product; and engaging the product delivery mechanism with the discharge element on the inner surface portion of the door assembly to release the selected product through the portal into the door zone as the product delivery mechanism moves past the portal in at least one of the vertical and the horizontal planes.

20. The method of claim 19, further comprising:

releasing the selected product through the portal by rotating a portion of the product delivery mechanism based on engagement with the discharge element.

21. A vending machine, comprising:

a cabinet having a product storage zone;

a product delivery mechanism configured to transport a selected product in the product storage zone, the product delivery mechanism including a transport carrier supporting the selected product from the bottom and having a base portion, an outer shroud member, and an inner shroud member nested within the outer shroud member, each of the inner and outer shroud members enclosing more than half a circumference of the selected product;

a door assembly configured to selectively provide access to the product storage zone, the door assembly including an outer surface and an inner surface that are spaced to define an inner door zone;

a portal formed in the inner surface of the door assembly, the portal leading from the product storage zone into the inner door zone;

a dispensing area having an opening formed in the outer surface of the door assembly that provides access to the selected product, wherein the inner door zone includes a vertical drop zone that extends from the portal to the dispensing area; and a discharge element on the inner surface of the door assembly, the discharge element configured to cooperate with the product delivery mechanism to dispense the selected product through the portal, wherein the outer shroud member is adapted to vertically shift relative to the inner shroud member and pivot relative to the base portion upon engagement of the transport carrier with the discharge element.

* * * * *

UNITED STATES PATENT AND TRADEMARK OFFICE

CERTIFICATE OF CORRECTION

PATENT NO. : 8,469,230 B2
APPLICATION NO. : 11/973892
DATED : June 25, 2013
INVENTOR(S) : Perkins et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 506 days.

Signed and Sealed this
Twenty-third Day of December, 2014

Michelle K. Lee

Michelle K. Lee
*Deputy Director of the United States Patent and Trademark Office*